United States Patent [19]

Ferri

[11] 4,294,173

[45] Oct. 13, 1981

[54] AMMUNITION FOR A TOY WEAPON

[76] Inventor: Giampiero Ferri, Via Stoppani 38, Florence, Italy

[21] Appl. No.: 44,904

[22] Filed: Jun. 4, 1979

[30] Foreign Application Priority Data

Jun. 7, 1978 [IT] Italy ..... 9492 A/78

[51] Int. Cl.[3] ..... F42B 4/02

[52] U.S. Cl. ..... 102/281

[58] Field of Search ..... 102/281

[56] References Cited

U.S. PATENT DOCUMENTS

| | | | |
|---|---|---|---|
| 2,848,950 | 8/1958 | Donaldson | 102/281 |
| 2,998,777 | 9/1961 | Ryan | 102/281 |
| 3,318,245 | 5/1967 | Ferri et al. | 102/281 |
| 3,349,710 | 10/1967 | Sposimo | 102/281 |
| 3,999,485 | 12/1976 | Ferri | 102/281 |

*Primary Examiner*—David H. Brown

*Attorney, Agent, or Firm*—Hopgood, Calimafde, Kalil, Blaustein & Judlowe

[57] ABSTRACT

Ammunition for a toy-weapon comprises an injection moulded support having seats for explosive charges. The charges are sealed within the seats by a separate cover for each seat. The covers are injection moulded simultaneously onto the seats of the support.

1 Claim, 10 Drawing Figures

AMMUNITION FOR A TOY WEAPON

BACKGROUND OF THE INVENTION

1. Field of the Invention.

The present invention relates to ammunition for toy-weapons.

2. Description of the Prior Art.

There is proposed in my Italian Patent Specification No. 992191 filed July 10, 1973 under serial no. 9544 A/73 and in equivalent Patent Specifications filed in Great Britain and U.S.A., ammunition for toy-weapons, comprising an injection moulded thermoplastics support having seats for explosive charges. A thermoplastics cover is injection moulded onto the support to close and seal the seats. In the zone of each seat, the cover is of reduced thickness to enable it to yield under the internal pressure of the explosive gases.

The single cover enclosed all of the seats with the result that the ammunition is not of traditional appearance.

SUMMARY OF THE INVENTION

According to the invention, there is provided ammunition for a toy weapon, said ammunition comprising a moulded plastics support including means defining a plurality of seats, explosive charges within the seats, and means for sealing the charges within the seats, said sealing means comprising a separate plastics cover for each said seat, each said plastics cover being injection moulded onto its associated seat separately from the or each other seat.

Further according to the invention, there is provided a process for the production of ammunition for toy-weapons, said process comprising the steps of forming a support having a plurality of seats for explosive charges, by injection moulding a plastics material, depositing explosive charges in said seats, arranging the support with the explosive charges in a second injection mould, and forming, in said second mould, a separate cover for each said seat using a plastics material which is fused to the seat, said covers being injected simultaneously, but separately.

BRIEF DESCRIPTION OF THE DRAWINGS

Embodiments of the invention will now be described, by way of example only, with reference to the accompanying diagrammatic drawings, in which.

DESCRIPTION OF THE PREFERRED EMBODIMENTS

Figure 1:
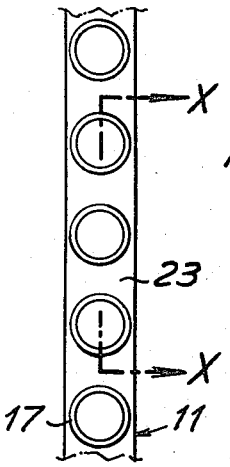
FIGS. 1, 2 and 3 are plan views showing different configurations of ammunition in accordance with the invention.
Figure 2:
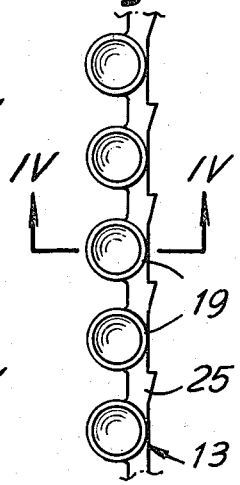
Figure 3:
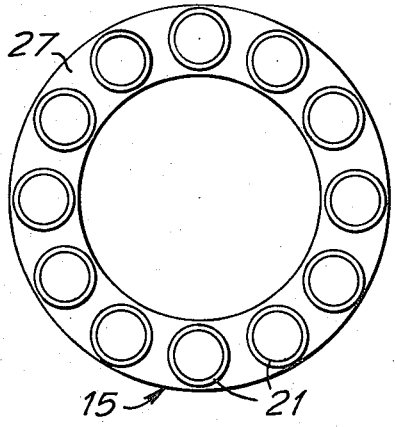

Ammunition 11, 13 and 15 (FIGS. 1, 2 and 3) comprises a series of mutually spaced seats 17, 19 and 21 carried by a support 23, 25 and 27 respectively. The support may lie at the bottom of the seats or at an intermediate level between the two ends of the seats. The seats and the support are injection moulded, as an integral structure, in a first injection mould as described in my aforesaid patent specification.

Figure 9:
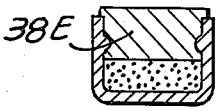
Figure 10:
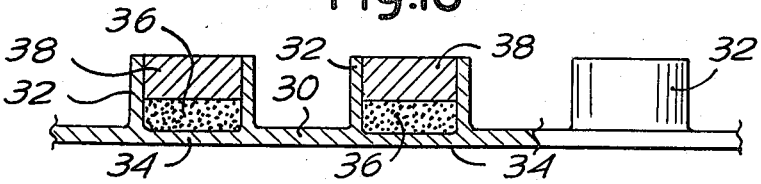
FIG. 10 is a section on line X—X of FIG. 1.

In the section of FIG. 10, the support is denoted by 30, while 32 denotes the side walls and 34 denotes the bottoms of the seats. The reference numerals used in FIGS. 4 to 9 are similar to those used in FIG. 10.

Each seat contains an explosive charge 36 which is sealed within the seat. Sealing of the seats is effected by injection moulding a separate cover 38 for each seat of the ammunition. The injection moulding is carried out simultaneously for all the seats of the ammunition but with separate injections to form the individual covers. These covers become fused with the portion of the side wall 32 extending above the charge 36, with the cross-sectional thickness and shape of the covers being determined by the shape of a second mould, into which the ammunition is introduced after the deposition of the explosive charges 36, for the injection moulding of the covers. Part of the second mould may be the same as in the first mould.

For the first and second mould, use may be made of a support for supporting two or more units of ammunition, which support could be present also in the first mould and engage the elements simultaneously injection moulded in the first mould; a support of this type may be constituted for example by a sheet of cardboard or the like, or metal, which constitutes a carrier for the units of ammunition simultaneously moulded and which need to be subsequently handled for the introduction of the charges into the seats, and for the injection of the covers in the second injection mould.

Figure 7:
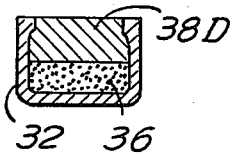
Figure 8:
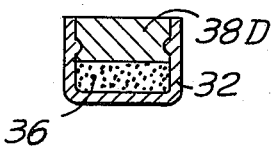

The covers may be retained simply by fusing with the surface material of the seats. The covers may also be positively held by the formation of rib-like projections on the interior of the seats as shown in FIGS. 4, 5, 6, 8 and 9 or by undercuts as shown in FIG. 7. Each rib-like projection may be in the form of a continuous annular projection or may be of discontinuous form.

Figure 4:
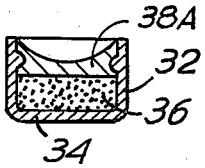
FIGS. 4 to 9 are sections taken on line IV—IV of FIG. 2 showing different sealing arrangements for the seats of the ammunition.
Figure 5:
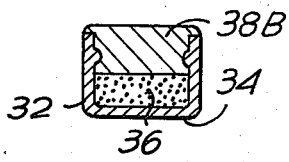
Figure 6:
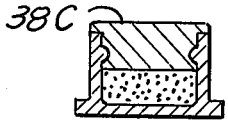

In FIG. 4, the cover 38A has a lenticular shape to provide reduction in the thickness of the cover. According to FIG. 5, the cover 38B extends across the end of the side wall 32 of the seat and covers the end of the side wall, with the exposed portion of the cover being rounded at its peripheral edge. The cover 38C of FIG. 6 similarly extends across the end of the side wall, but has an angular peripheral edge rather than a rounded peripheral edge. The covers 38D of FIGS. 7 and 8 terminate in a flat external surface flush with the end of the side wall 32. In FIG. 9 the cover extends only partly across the end of the side wall.

In each case the sealing covers 38, 38A . . . , 38E are made by injection moulding simultaneously for each complete unit of ammunition or for a group of several units of ammunition which have been moulded simultaneously and charged simultaneously with the explosive, while being held on a grid-like support.

The arrangement of the charges and the shape of the ammunition may differ from that shown in the drawings.

The ammunition described herein is of substantially traditional appearance while retaining the benefits obtained by using injection moulding techniques to seal the charges within the seats.

I claim:

1. A process for the production of ammunition for toy-weapons, said process comprising the steps of forming a support having a plurality of seats for explosive charges, by injection moulding a plastics material, depositing explosive charges in said seats, arranging the support with the explosive charges in a second injection mould, and forming, in said second mould, a separate cover for each said seat using a plastics material which is fused to the seat, said covers being injected simultaneously, but separately.

* * * * *